US011261591B1

(12) United States Patent
Sim

(10) Patent No.: US 11,261,591 B1
(45) Date of Patent: Mar. 1, 2022

(54) TOILET BOWL FORMULA DISPENSING DEVICE

(71) Applicant: Robin Sim, Irvine, CA (US)

(72) Inventor: Robin Sim, Irvine, CA (US)

( * ) Notice: Subject to any disclaimer, the term of this patent is extended or adjusted under 35 U.S.C. 154(b) by 0 days.

(21) Appl. No.: 16/384,855

(22) Filed: Apr. 15, 2019

Related U.S. Application Data

(60) Provisional application No. 62/657,105, filed on Apr. 13, 2018.

(51) Int. Cl.
*E03D 9/02* (2006.01)

(52) U.S. Cl.
CPC ..... *E03D 9/02* (2013.01)

(58) Field of Classification Search
CPC ..... E03D 9/02
USPC ..... 4/223–224
See application file for complete search history.

(56) References Cited

U.S. PATENT DOCUMENTS 3,953,902 A * 5/1976 Taylor ..... E03D 9/038 4/227.5
4,764,992 A * 8/1988 Delia ..... E03D 9/038 4/227.6
D365,138 S * 12/1995 Puri ..... D23/208
6,178,564 B1 * 1/2001 Leonard ..... E03D 9/032 4/223
6,321,392 B1 * 11/2001 Sim ..... E03D 9/037 4/225.1
6,389,610 B1 * 5/2002 Hautmann ..... E03D 9/032 4/231
6,505,356 B1 * 1/2003 Leonard ..... E03D 9/032 4/231
6,530,094 B1 * 3/2003 Neo ..... E03D 9/031 137/205.5
6,588,026 B2 * 7/2003 Meier ..... E03D 9/02 4/224
6,662,379 B2 * 12/2003 Nguyen ..... E03D 9/037 4/225.1
6,662,380 B1 * 12/2003 Leonard ..... E03D 9/032 4/231
6,738,989 B2 * 5/2004 Harbutt ..... E03D 9/037 4/227.1
8,281,423 B2 * 10/2012 Taylor ..... A61M 3/025 4/420.4
8,453,272 B2 * 6/2013 Sim ..... E03D 9/037 4/225.1
8,603,257 B2 * 12/2013 Burt ..... E03D 9/032 134/18
8,925,119 B2 * 1/2015 Burt ..... E03D 9/037 4/225.1
9,580,896 B2 * 2/2017 Hopkins ..... E03D 9/038
10,173,821 B2 * 1/2019 Ma ..... B65D 75/5861
2010/0205732 A1 * 8/2010 Muhlhausen ..... E03D 9/032 4/226.1

(Continued)

*Primary Examiner* — Lori L Baker
(74) *Attorney, Agent, or Firm* — Eric Karich; Karich & Associates

(57) ABSTRACT

A toilet bowl formula dispensing device for dispensing an active agent into a toilet bowl has a flexible container with a first polymeric layer and a second polymeric layer sealed at an outer perimeter to form an internal compartment. The device further has an inlet port and an outlet port through the flexible container for allowing fluid flow through the flexible container, and a resealable opening into the flexible container for allowing insertion of the active agent into the internal compartment.

6 Claims, 10 Drawing Sheets

(56) References Cited

U.S. PATENT DOCUMENTS

| | | | | |
|---|---|---|---|---|
| 2011/0219525 | A1* | 9/2011 | Burt | E03D 9/037 4/224 |
| 2012/0266920 | A1* | 10/2012 | Burt | E03D 9/005 134/24 |
| 2014/0020164 | A1* | 1/2014 | Berry | E03D 9/032 4/224 |
| 2014/0245530 | A1* | 9/2014 | Slade | E03D 9/037 4/223 |
| 2019/0127129 | A1* | 5/2019 | Van Den Hoonaard | B65D 47/122 |

* cited by examiner

TOILET BOWL FORMULA DISPENSING DEVICE

CROSS-REFERENCE TO RELATED APPLICATIONS

This application for a utility patent claims the benefit of U.S. Provisional Application No. 62/657,105, filed Apr. 13, 2018.

BACKGROUND OF THE INVENTION

Field of the Invention

This invention relates generally to toilet bowl formula dispensing device, and more particularly to a toilet bowl device for dispensing a cleaning agent, deodorizer, fragrance, formulation for septic care and maintenance, and/or related agents that a user may want to introduce into a toilet bowl upon flushing.

Description of Related Art

The prior art teaches various devices for dispensing various forms of cleaning chemicals into a toilet bowl for cleaning the bowl. The most common approach is simply to drop a chemical tablet into the reservoir of the toilet, so that water from the reservoir disinfects the bowl once flushed. The disadvantage of this approach is that the chemical degrade the toilet's tank components, rubber sealing flap, and metal parts resulting in damage and leaks.

Sim, U.S. Pat. No. 8,453,272, teaches a toilet cleaning device that attaches to a toilet using inlet and outlet conduits that flow through a rigid housing that contains a cleaning agent for cleaning a toilet bowl. As refill water flows through the rigid housing, it dissolves some of the cleaning agent, which then flows into the toilet bowl. This prevents the cleaning agent from contacting the rubber sealing flap.

Hopkins, U.S. Pat. No. 9,580,896, teaches a similar device for the controlled release of an active agent into an aqueous system for a prolonged duration of time. The apparatus includes a flexible container that contains and also controls dissolution of at least one active agent to enable an increase in active agent lifetime. The Hopkins device must contain the active agent in a particular configuration which is permanently enclosed and set during manufacture, and then disposed of in an ecologically wasteful manner. The Hopkins device cannot accept alternative or replacement materials in a reusable manner, as provided by the present invention.

SUMMARY OF THE INVENTION

The present invention teaches certain benefits in construction and use which give rise to the objectives described below.

The present invention provides a toilet bowl formula dispensing device for dispensing an active agent into a toilet bowl, having a flexible container with a first polymeric layer and a second polymeric layer sealed at an outer perimeter to form an internal compartment. The device further has an inlet port and an outlet port through the flexible container for allowing fluid flow through the flexible container, and a resealable opening into the flexible container for allowing insertion of the active agent into the internal compartment.

A primary objective of the present invention is to provide a toilet bowl formula dispensing device having advantages not taught by the prior art.

Another objective is to provide a toilet bowl formula dispensing device with superior construction for simple and cost-effective manufacturing.

Another objective is to provide a toilet bowl formula dispensing device that includes an opening through which the user can insert replacement chemical and/or formula tablets, so that the device is re-usable and lessens waste.

Yet another objective is to provide a toilet bowl formula dispensing device which has an outlet port which is positioned lower than the tablet insertion opening, so that any fluids in the device drain from the device following use. The outlet port can also be strategically placed to reduce or increase formula dissolve rate.

A further objective is to provide inlet and outlet ports which make the present invention universal with the pipes and valves of various toilet manufacturers.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a toilet bowl formula dispensing device for delivering an active agent to a toilet bowl. The active agent may be any form of cleaning agent, deodorizer, fragrance, formulation for septic care and maintenance, and/or related agents that a user may want to introduce into a toilet bowl upon flushing. The active agent may include any form of cleaning and/or disinfecting and/or antibacterial chemicals, and/or fragrance, microbes, enzymes, septic maintenance formula, and/or any other chemicals that may be desirable to add to a toilet bowl and/or septic system.

Figure 1:
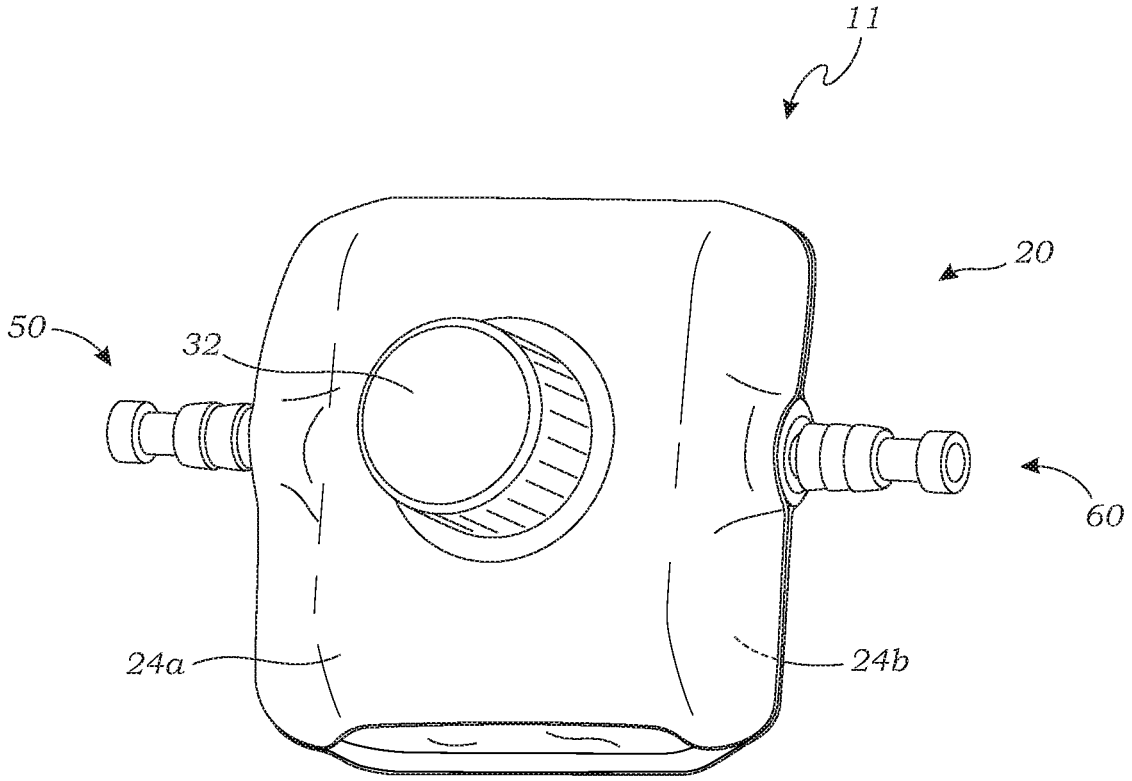
FIG. 1 is a perspective view of a toilet bowl formula dispensing device according to one embodiment of the present invention.
Figure 2:
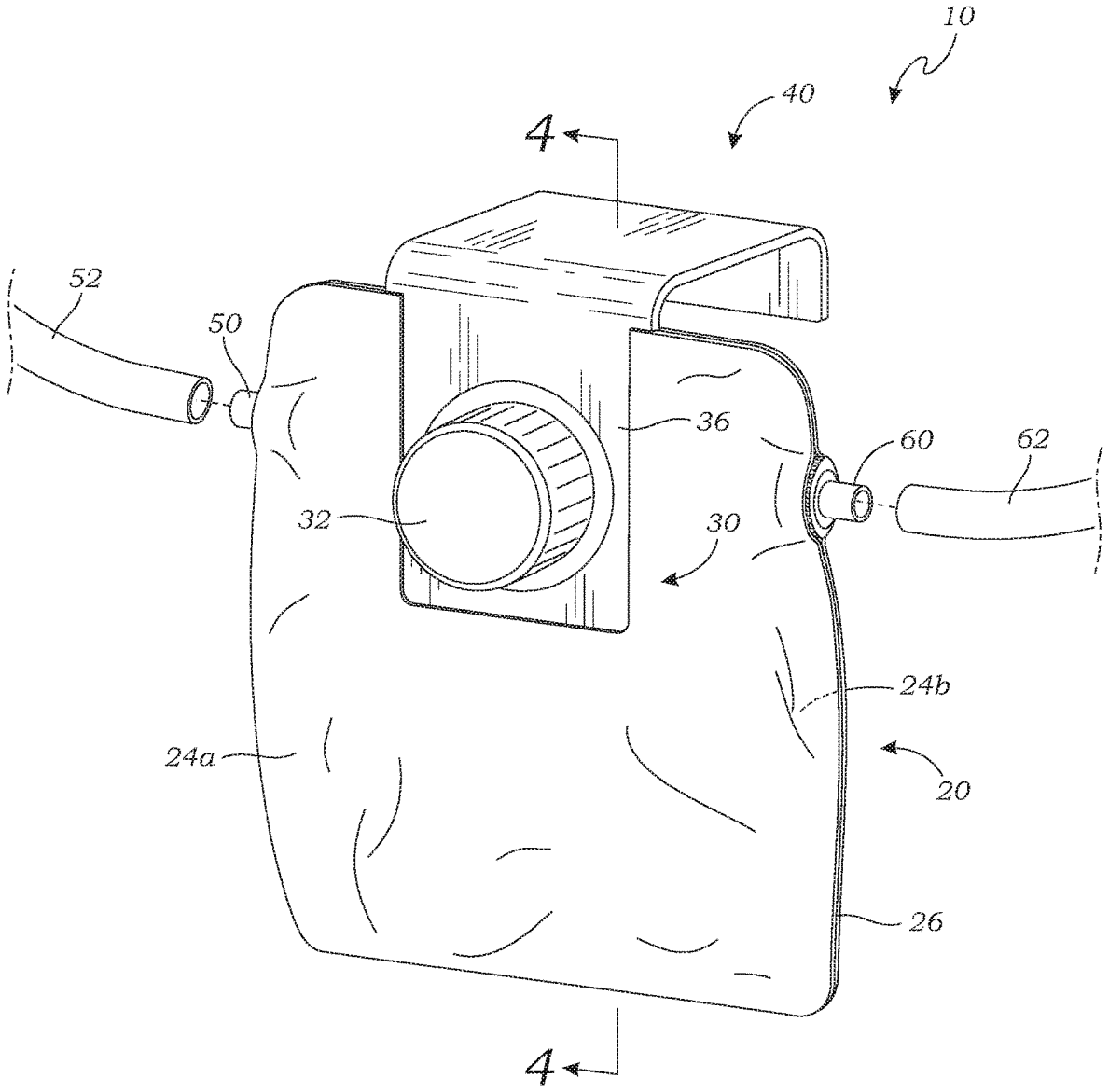
FIG. 2 is a perspective view of a toilet bowl formula dispensing device according to a second embodiment of the present invention.
Figure 3:
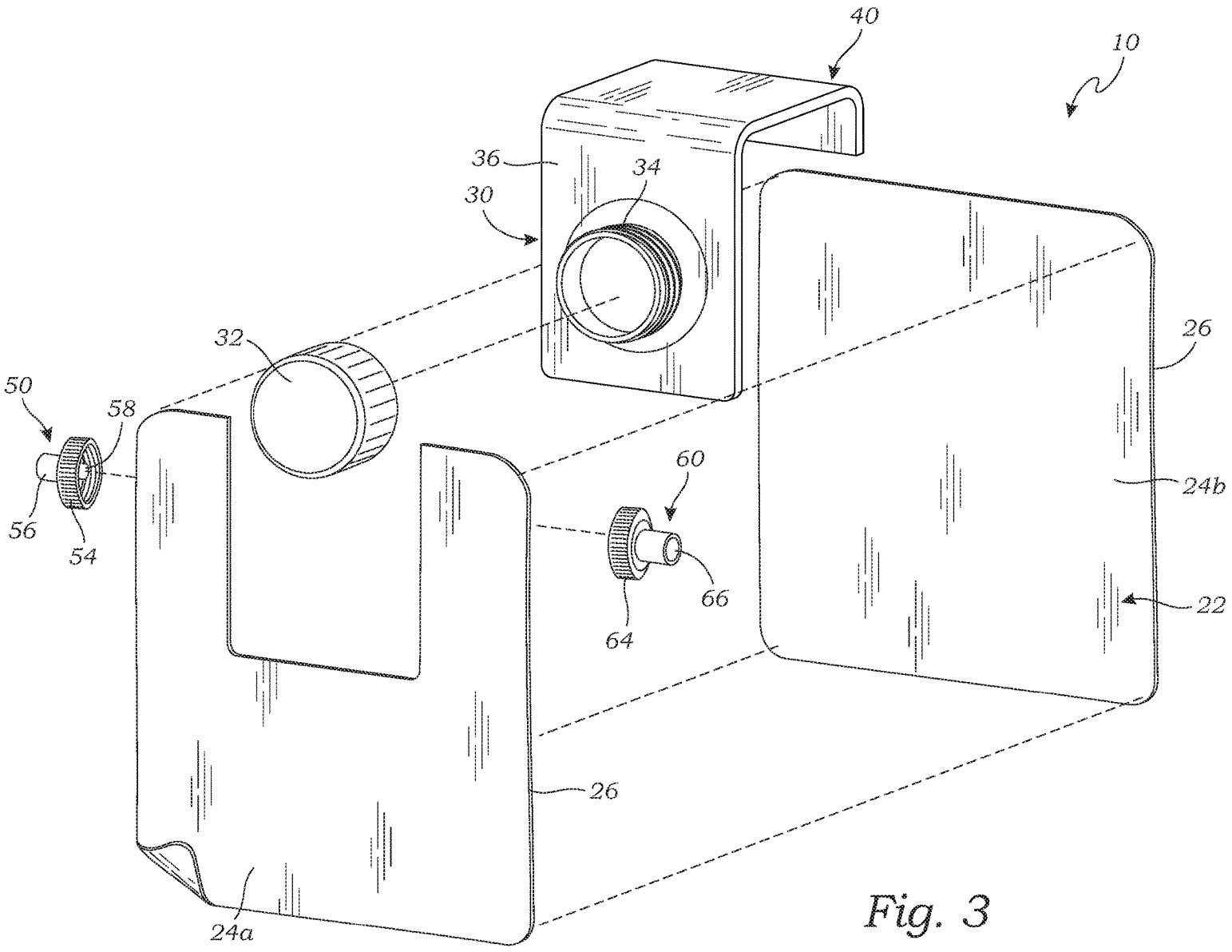
FIG. 3 is an exploded perspective view of the toilet bowl formula dispensing device.
Figure 4:
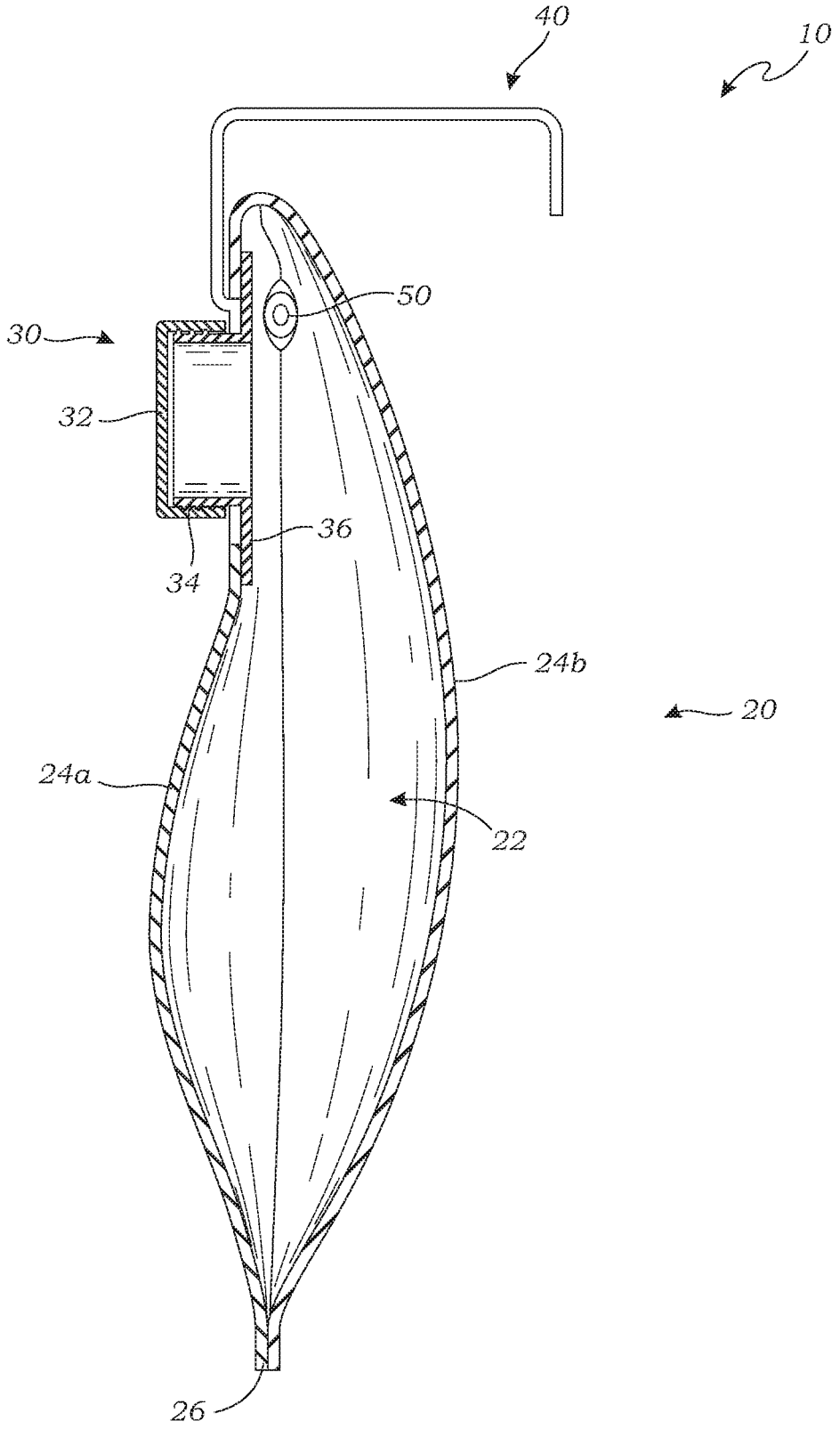
FIG. 4 is a sectional view thereof taken along line 4-4 in FIG. 2.

FIG. 1 is a perspective view of a toilet bowl formula dispensing device 11 according to one embodiment of the present invention. FIG. 2 is a perspective view of a toilet bowl formula dispensing device 10 according to a second embodiment of the present invention. FIG. 3 is an exploded perspective view of the toilet bowl formula dispensing device 10. FIG. 4 is a sectional view thereof taken along line 4-4 in FIG. 2.

Figure 6:
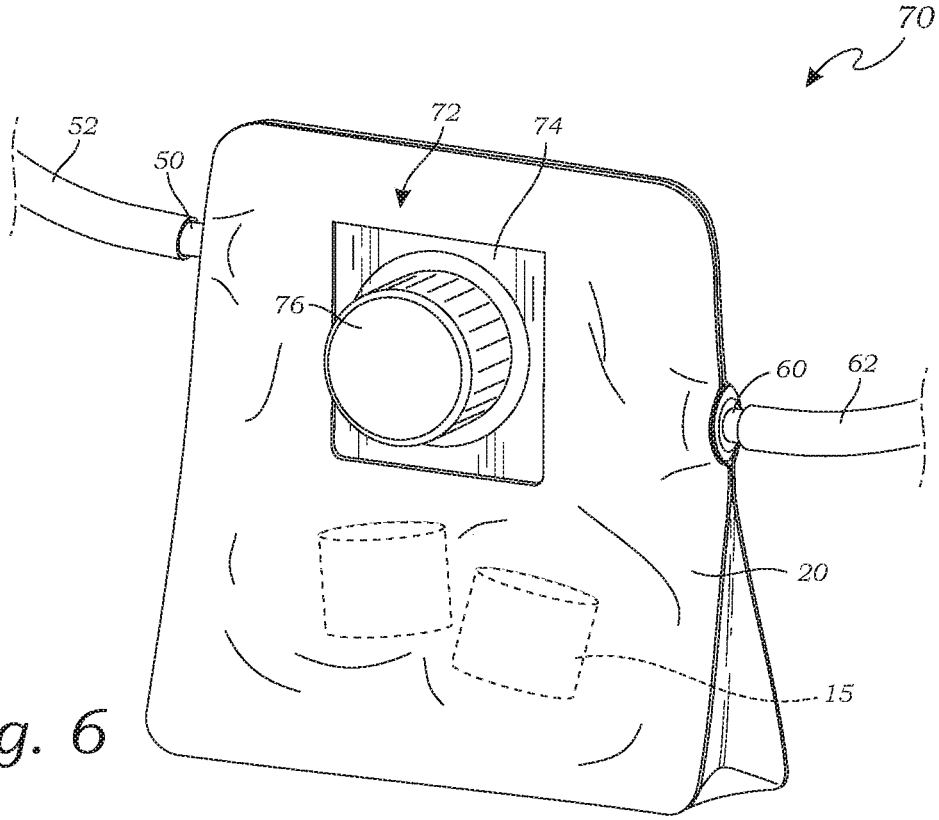
FIG. 6 is a front perspective view of a third embodiment of the toilet bowl formula dispensing device.
Figure 7:
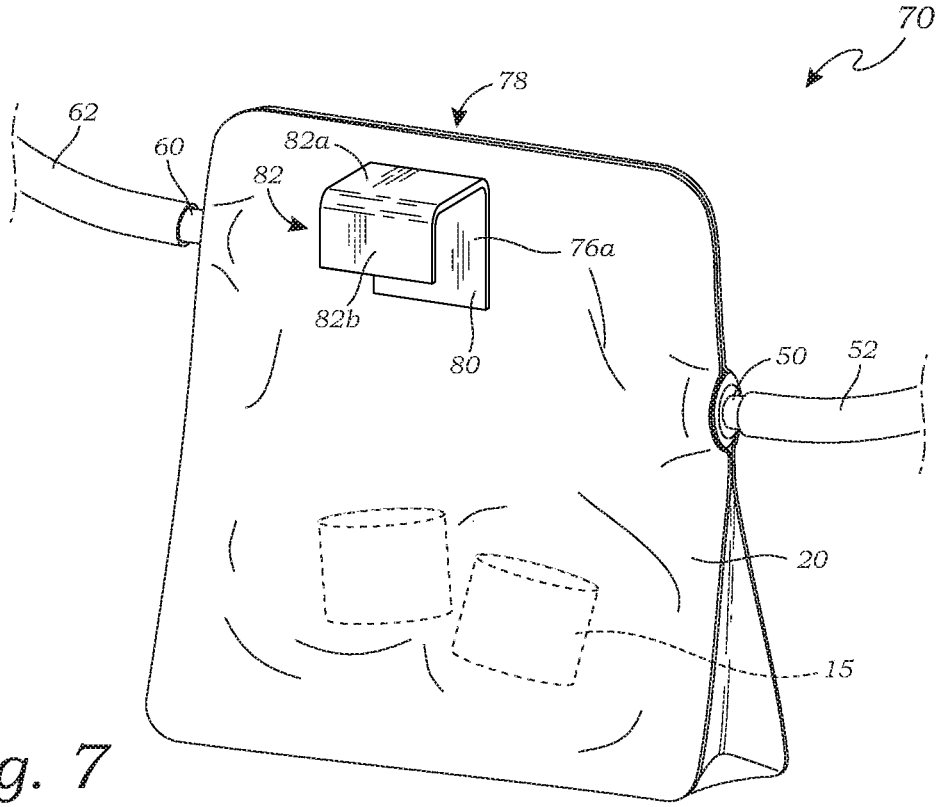
FIG. 7 is a rear perspective view thereof.

As shown in FIGS. 1-4, the toilet bowl formula dispensing device 11 and 10 include a flexible container 20 which forms an internal compartment 22 that is sealed for containing the active agent 15 (e.g., typically in the form of pellets, tablets, granules, etc., as shown in FIGS. 6-7). The flexible container 20 includes front and rear polymeric layers 24*a* and 24*b* which are sealed together at an outer perimeter 26 to form the internal compartment 22, which is illustrated in FIG. 4. In this embodiment, the outer perimeter 26 is sealed with a weld line (e.g., thermal weld), although the term "sealed" is defined to include any form of bonding (e.g., physical, chemical, adhesive, weld, fasteners, etc.), or integral connection in the event that the sheets are formed by a single sheet that is folded. The front and rear polymeric layers 24*a* and 24*b* may be in the form of a single integral sheet that is suitably cut, and folded in half, or alternatively, two separate sheets (webs) may be used, and entirely connected via welding. The layers 24*a* and 24*b* may further have gussets or other constructions on any desired section of the outer perimeter 26 and/or the polymeric layers 24*a* and/or 24*b*.

As shown in FIG. 4, the flexible container 20 may be sold empty, so that the internal compartment 22 does not contain any of the active agent 15, so that a user may insert any desired active agent 15 as needed. The device 11 and 10 may then be re-filled as desired, without the need to dispose of and replace the device 10 and 11 after each use. In alternative embodiments, the device 10 and 11 may come filled with some of the active agent 15, and the user may simply refill the device 10 and 11 following use.

In the embodiments of FIGS. 1-4, the polymeric layers 24*a* and 24*b* of the flexible container 20 may be constructed of, for example, a composite such as FlexFilm®, or any other form of suitable material, such as thermoplastic sheet material, which may be lined (e.g., with foil, layered aluminum, or other materials) or unlined, in order to provide a liquid-impervious barrier with suitable durability and any other characteristics that are desired. The polymeric layers 24*a* and 24*b* may be constructed of high density polyethylene to protect against bleach chemicals such as chlorine, bromine, etc. In alternative embodiments, layers may be constructed of polyethylene, linear low density polyethylene, etc., for use with enzymes, microbes, nutritive carriers, surfactants, detergents, fragrance products, etc. Other materials may be used to form the polymeric layers 24*a* and 24*b*, as desired by one skilled in the art, and such alternatives should be considered within the scope of the present invention.

As shown in FIGS. 1-4, the toilet bowl formula dispensing device 10 and 11 further includes a resealable opening 30 into the flexible container 20 for allowing insertion of the active agent 15 into the internal compartment. In these embodiments, the resealable opening 30 is in the form of an access port covered by a cap 32. In alternative embodiments, some of which are discussed in greater detail below, the resealable opening 30 may be in the form of a sealable zipper having an interlocking groove and ridge that form a seal when closed (shown in FIG. 10), such as the mechanism commonly sold under the trademark ZIPLOC®. Alternatively, the resealable opening 30 may also be any other form of closable opening known in the art.

The toilet bowl formula dispensing device 10 and 11 may further include a hanging mechanism 40 for hanging the toilet bowl formula dispensing device 10 and 11 on a toilet 12. One embodiment of the hanging mechanism 40, shown in FIGS. 1-4, is in the simple form of a hook shaped body that extends from the access port 30. Alternative forms of the hanging mechanism 40 are illustrated in other figures, and discussed in greater detail below.

The toilet bowl formula dispensing device 10 and 11 further include an inlet port 50, and an outlet port 60 (collectively, "port components"). The port components 50 and 60 are integrated into the flexible container 20 to communicate between the inside and outside of the flexible container 20, typically by heat welding or otherwise bonding or affixing the port components 50 and 60 between the polymeric layers 24*a* and 24*b* at the perimeter, or through an aperture in one of the polymeric layers 24*a* and/or 24*b*, forming a water-tight seal with the polymeric layers 24*a* and/or 24*b*.

The access port 30 is provided to allow the user to add the active agent into the flexible container 20, with the cap 32 being provided to close the access port 30. The access port 30 may be in any suitable shape and arrangement that enables the user to add the active agent. In these embodiments, the access port 30 includes an externally threaded cylindrical spout 34 extending from an annular flange 36 which is bonded or otherwise attached to the flexible container 20. The cap 32 may be any form of closure known in the art (e.g., threaded, as shown, or snap/friction, in alternative embodiments), in this case a simple internally threaded cap.

In these embodiments, the hanging mechanism 40 extends from the planar sheet 36 of the access port 30. In alternative embodiments, however, the hanging mechanism 40 may be attached to the flexible container 20 using another attachment mechanism, such as but not limited to thermal welding, adhesives, mechanical fasteners, loops/hooks, and other methods known in the art.

As shown in FIGS. 1-4, the inlet port 50 includes an annular base 54 and an attachment nipple 56. The annular base 54 is adapted to be bonded to the flexible container 20, at the perimeter 26, so that an inner conduit 58 of the base communicates with the inside of the flexible container 20. The attachment nipple 56 is adapted to be attached to an inlet tube 52, best shown in FIG. 12, which is attached to the toilet 12, as described in greater detail below.

Similarly, the outlet port 60 includes an annular base 64 and an attachment nipple 66. The annular base is adapted to be bonded to the flexible container 20, at the perimeter 26, so that an inner conduit 68 communicates with the inside of the flexible container 20. The attachment nipple 66 is adapted to be attached to an outlet tube 62, which is attached to the toilet 12, as described in greater detail below. For purposes of this application, the term "annular" is defined to include any form of ring or equivalent shape, whatever the cross sectional shape (e.g., round, oval, square, etc.).

Figure 5:
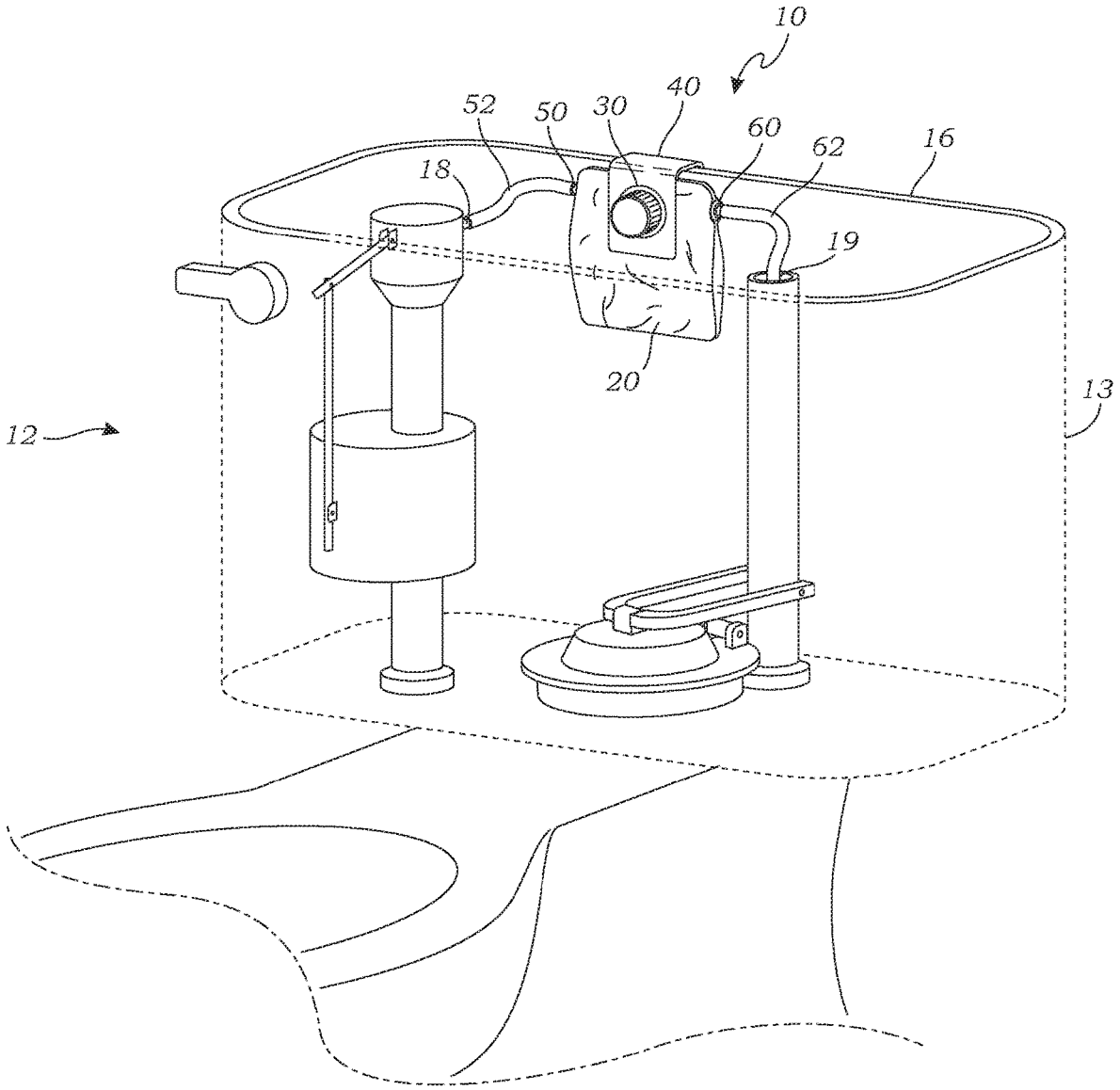
FIG. 5 is a perspective view of a toilet having the toilet bowl formula dispensing device installed therein.

FIG. 5 is a perspective view of a toilet 12 having the toilet bowl formula dispensing device 10 or 11 installed in a toilet tank 13. As shown in FIG. 5, once the toilet bowl formula dispensing device 10 or 11 has been filled with the active agent 15 (as shown in FIGS. 6-7) via the access port 30, the device 10 or 11 is hung from an upper perimeter 16 (or other suitable structure) of the toilet tank 13 using the hanging mechanism 40. The water inlet tube 52 is attached to a fill valve 18 of the toilet 12, and to the inlet port 50 of the toilet bowl formula dispensing device 10 or 11. The water outlet tube 62 is attached to the flush valve 19 of the toilet 12 and the water outlet port 60 of the device 10 or 11. In this manner, once the toilet 12 has been flushed with water from the tank 13 (which does not contain the active agent 15), it is refilled with water from the flush valve 19, which flows through the toilet bowl formula dispensing device 10 or 11 to receive the active agent 15.

FIG. 6 is a front perspective view of a third embodiment of the toilet bowl formula dispensing device 70. FIG. 7 is a rear perspective view thereof. As shown in FIGS. 6-7, in the second embodiment, the toilet bowl formula dispensing device 70 includes an access port 72 that includes a base flange 74 and a cap 76 that are similar to the first embodiments 10 and 11, but which is separate from the hangar device 78. As shown in FIG. 7, the hangar device 78 includes a base plate 80 that is bonded in a portion 76*a* to the flexible container 20, and a hook 82 that includes a horizontal component 82*a* and a downwardly extending vertical component 82*b*. The hangar device 78 is preferably thin, so that it does not interfere with the toilet lid being seated over the toilet tank 13.

In one embodiment, the inlet port 50 and the outlet port 60 are on opposite sides of the flexible container 20; however, in alternative embodiments they might be located on the same side, or in different locations. In the embodiment of FIGS. 6-7, the inlet port 50 is positioned higher (i.e., at a higher elevation when the flexible container 20 is hanging from the hangar device 78) than the outlet port 60, described in greater detail below.

Figure 8:
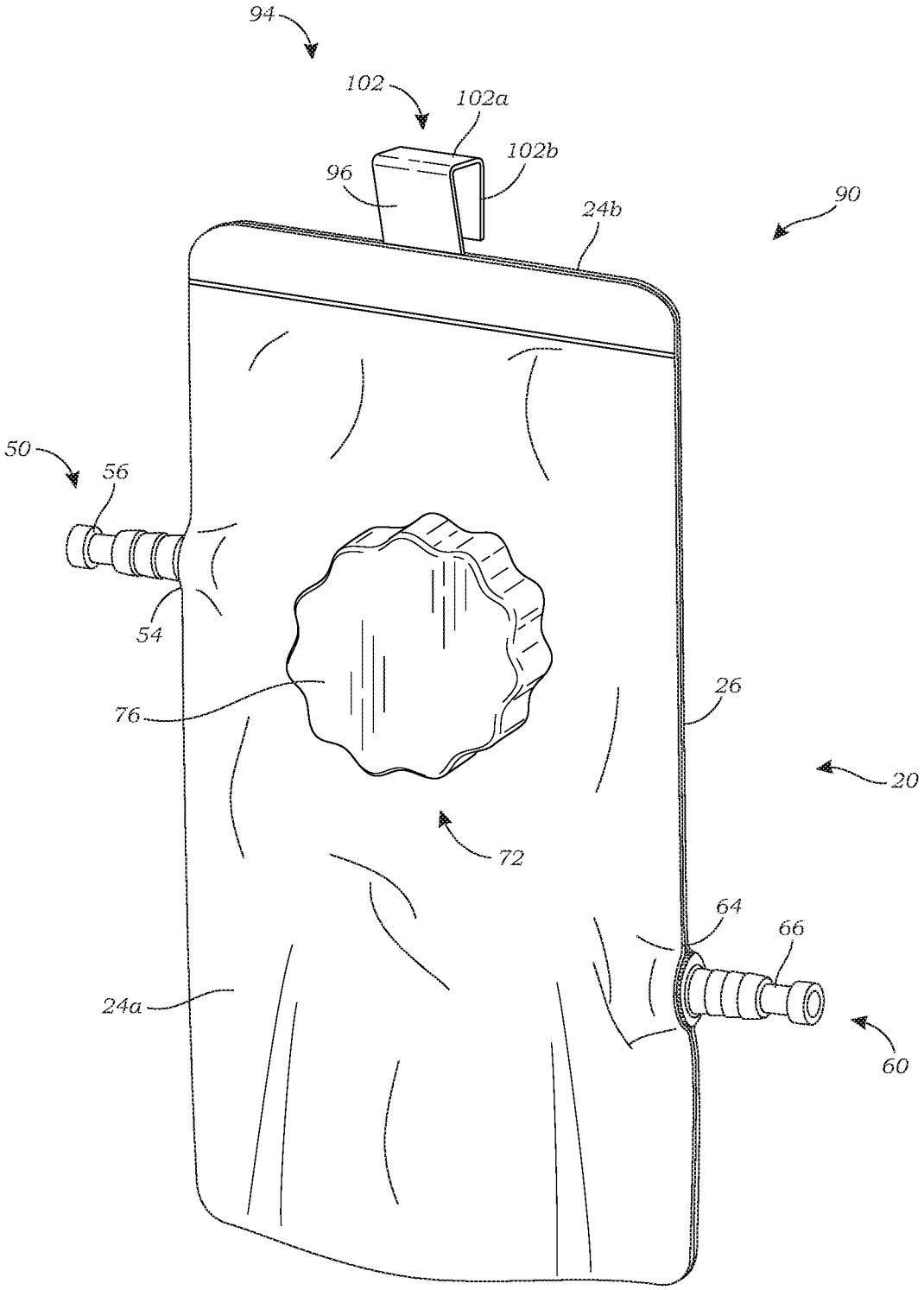
FIG. 8 is a perspective view of a toilet bowl formula dispensing device according to a fourth embodiment of the present invention.
Figure 9:
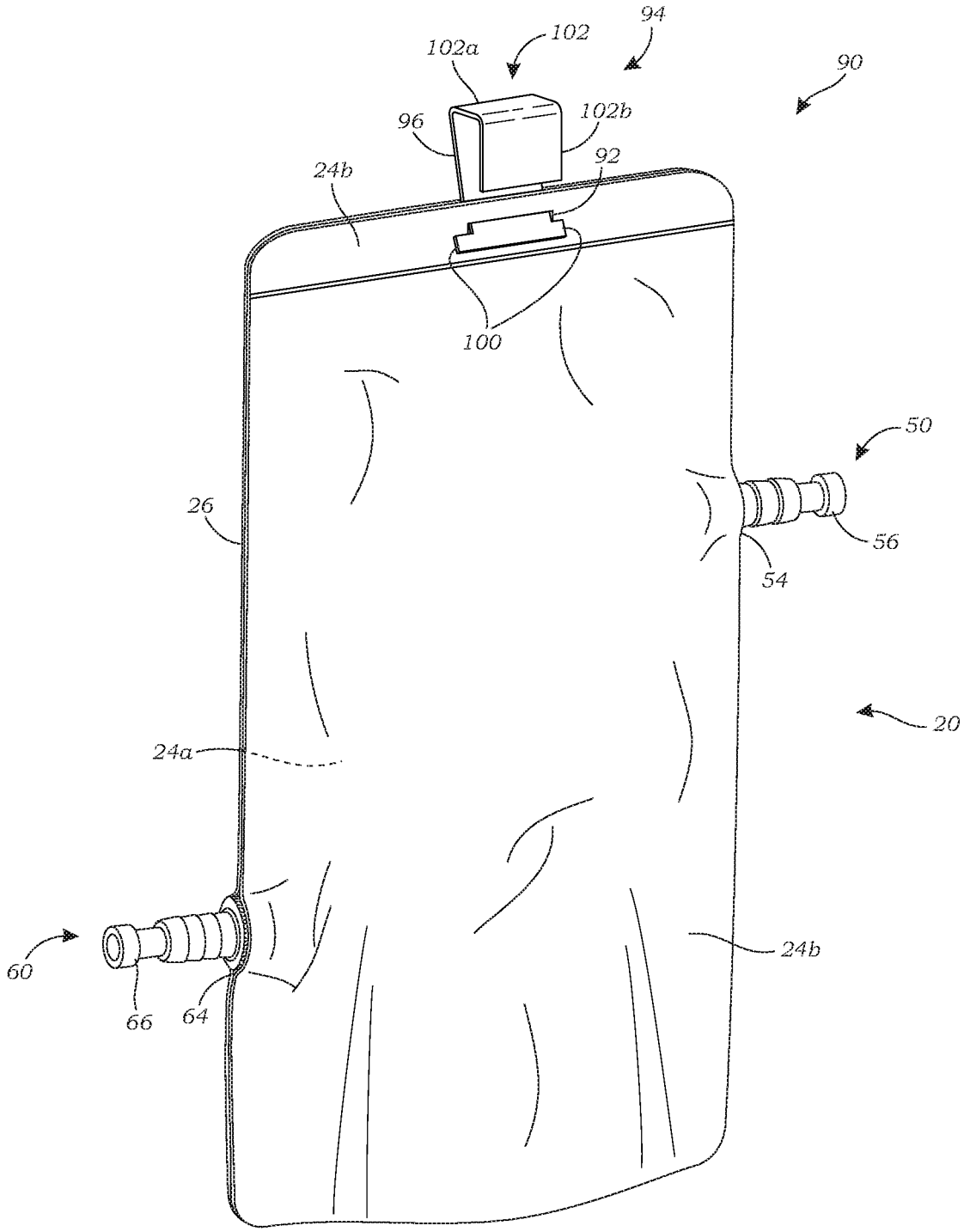
FIG. 9 is a rear perspective view thereof.

FIG. 8 is a perspective view of a toilet bowl formula dispensing device 90 according to a fourth embodiment of the present invention. FIG. 9 is a rear perspective view thereof. Similar to the embodiment of FIGS. 6-7, the inlet port 50 may be positioned higher on the perimeter 26 of the formula dispensing device 90 than the outlet port 60. The outlet port 60 may be positioned below the access port 72, so that once the device 90 has been filled with water following a flush, the fluid drains from the device 90. Not only does this keep the internal compartment 22 (shown in FIG. 4) at least mostly empty of water, but also, when the cap 76 is removed (such as for adding more active agent 15), water will not spill out of the access port 72.

As shown in FIGS. 8-9, the flexible container 20 also includes the front and rear polymeric layers 24*a* and 24*b* which are bonded together at the outer perimeter 26. In this embodiment, the rear polymeric layer 24*b* has a slot 92 through the container 20 through which a hanging mechanism 94 may pass. In this embodiment, the slot 92 is adjacent the top edge, through the rear polymeric layer 24*b*. The hanging mechanism 94 of this embodiment includes a base plate 96 having lateral protrusions 100 that extends laterally further than the base plate 96, and the slot 92, thereby forming an anchor for holding the hanging mechanism 94 on the device 10. A hook 102 is formed opposite the lateral protrusions 100. The hook 102 may have a horizontal component 102*a* and a downwardly extending component 102*b*, which together enable hanging the device 90. In this embodiment, the lateral protrusions 100 prevent detachment of the base plate 96 from the rear layer 24*b*. The slot 92 may be rectangular, ovular, or any other shape that prevents the lateral protrusions 100 from dislodging. In alternative embodiments, the hanging device may include other forms of attachments (e.g., hooks and loops, other forms of fasteners, etc.), or may further allow the toilet bowl formula dispensing device 90 to be hung from an overflow pipe. Alternatively, the formula dispensing device 90 may be used without a hanging device.

Figure 10:
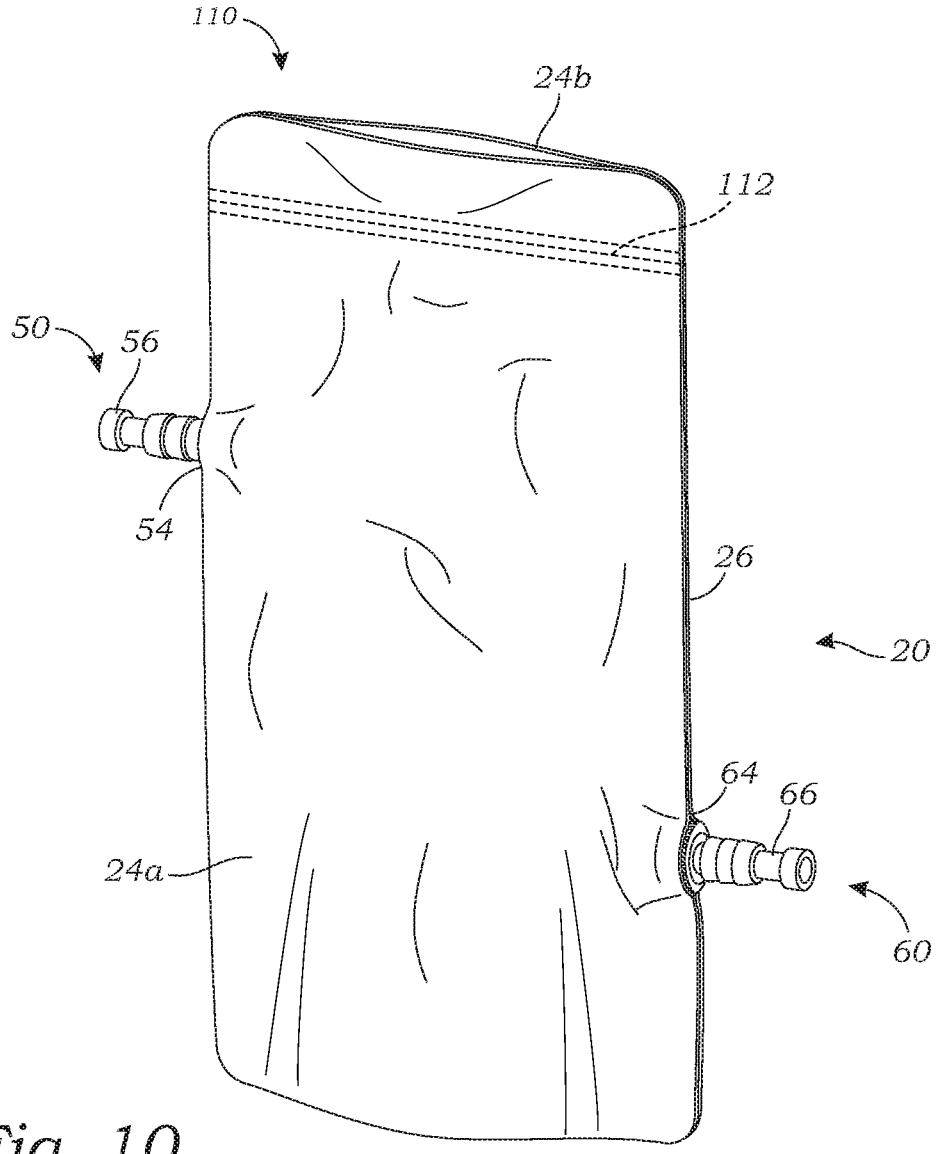
FIG. 10 is a perspective view of a toilet bowl formula dispensing device according to a fifth embodiment of the present invention.

FIG. 10 is a perspective view of a toilet bowl formula dispensing device 110 according to a fifth embodiment. In this embodiment, the flexible container 20 includes the zip seal closure 112 which is air and water-tight. The closure 112 may be sealed together as a groove and a ridge so that pressure applied forces the ridge into the groove to create a seal, or as any other form of seal closure known in the art.

Figure 11:
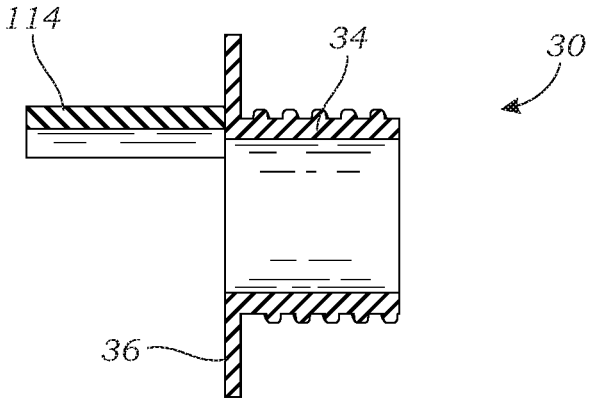
FIG. 11 is a side cross-sectional view of an access port of the toilet bowl formula dispensing device.

FIG. 11 is a side cross-sectional view of the access port 30 of the formula dispensing device 10, showing the cylindrical spout 34. As shown in FIG. 11, the planar sheet 36 is in the form of an annular flange extending around the access port 30, and it has an inwardly extending protrusion 114 (e.g., wall, post, etc.) which extends inwardly to hold the front and rear layers 24*a* and 24*b* of the flexible container 20 apart. The inwardly extending protrusion 114 allows a user to easily insert the active agent 15 (shown in FIGS. 6-7) into the internal compartment 22 of the flexible container 20 (shown in FIG. 4).

Figure 12:
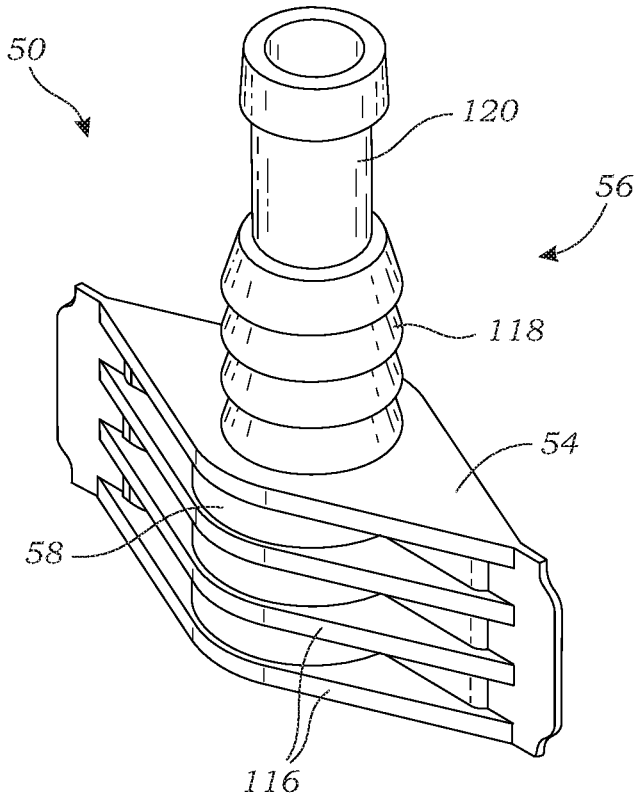
FIG. 12 is a perspective view of one embodiment of one of the port components of the device.

FIG. 12 is a perspective view of one embodiment of one of the port components 50 and 60 of the device 10. As described in the previous figures, each of the port components 50 and 60 includes the annular base 54 and the attachment nipple 56. The annular base 54 may be a generally rhombic shape, or any shape that may be securely attached to the flexible container 20 as illustrated. The base 54 defines the inner conduit 58 through which fluids flow into and out of the device 10. In this embodiment, the base 54 is formed of a plurality of lateral grooves 116 surrounding the inner conduit 58.

In this embodiment, the attachment nipple 56 comprises a first tubular portion 118 and a second tubular portion 120. The first tubular portion 118 has a larger diameter than the second tubular portion 120. The first tubular portion 118 is adapted for engaging larger diameter tubing, while the second tubular portion 120 is adapted for engaging smaller diameter tubing, so that a user can adapt the device 10, 70, 90, or 110 to different types of water tubes of toilets from various manufacturers.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A toilet bowl formula dispensing device for dispensing an active agent into a toilet bowl, the device comprising:

a flexible container having a first polymeric layer and a second polymeric layer sealed at an outer perimeter to form an internal compartment;

an inlet port and an outlet port through the flexible container for allowing fluid flow through the flexible container;

a resealable opening into the flexible container for allowing insertion of the active agent into the internal compartment;

wherein the inlet and outlet ports each include an annular base having an inner conduit, and an attachment nipple; and wherein the attachment nipple includes a first tubular portion and a second tubular portion, the first tubular portion having a larger diameter than the second tubular portion.

2. The toilet bowl formula dispensing device of claim 1, wherein the resealable opening includes an access port mounted on the flexible container for adding the active agent to the internal compartment, the access port having a cap for sealing the access port, closed.

3. The toilet bowl formula dispensing device of claim 2, wherein the outlet port is positioned below the access port.

4. The toilet bowl formula dispensing device of claim 1, wherein the flexible container has a slot adapted to receive a hanging mechanism therethrough, and the hanging mechanism having lateral protrusions that extends laterally further than the slot.

5. A toilet bowl formula dispensing device for dispensing an active agent into a toilet bowl, the device comprising:

a flexible container having a first polymeric layer and a second polymeric layer sealed at an outer perimeter to form an internal compartment;

an inlet port and an outlet port through the flexible container for allowing fluid flow through the flexible container;

a resealable opening into the flexible container for allowing insertion of the active agent into the internal compartment;

wherein the resealable opening includes an access port mounted on the flexible container for adding the active agent to the internal compartment, the access port having a cap for sealing the access port closed; and wherein the access port further comprises an inwardly extending protrusion which extends inwardly into the internal compartment of the flexible container to hold the front and rear layers of the flexible container apart.

6. A toilet bowl formula dispensing device for dispensing an active agent into a toilet bowl, the device comprising:

a flexible container having a first polymeric layer and a second polymeric layer sealed at an outer perimeter to form an internal compartment;

an inlet port and an outlet port through the flexible container for allowing fluid flow through the flexible container;

a resealable opening into the flexible container for allowing insertion of the active agent into the internal compartment; and wherein the inlet and outlet ports each include an annular base having an inner conduit, and an attachment nipple.

* * * * *